US007293965B2

(12) United States Patent
Tabuchi et al.

(10) Patent No.: US 7,293,965 B2
(45) Date of Patent: Nov. 13, 2007

(54) LIMITER DEVICE FOR VARIABLE DISPLACEMENT COMPRESSOR

(75) Inventors: Yasuo Tabuchi, Toyoake (JP); Manabu Saiki, Chiryu (JP); Masahito Yamashita, Nagoya (JP); Junichi Ohguchi, Toyoake (JP)

(73) Assignee: Denso Corporation, Kariya (JP)

( * ) Notice: Subject to any disclaimer, the term of this patent is extended or adjusted under 35 U.S.C. 154(b) by 533 days.

(21) Appl. No.: 10/778,227

(22) Filed: Feb. 17, 2004

(65) Prior Publication Data

US 2004/0165993 A1 Aug. 26, 2004

(30) Foreign Application Priority Data

Feb. 21, 2003 (JP) ..... 2003-044743
Apr. 11, 2003 (JP) ..... 2003-108117

(51) Int. Cl.
*F04B 1/26* (2006.01)

(52) U.S. Cl. ..... 417/222.2; 417/213

(58) Field of Classification Search ..... 417/222.2, 417/222.1, 213
See application file for complete search history.

(56) References Cited

U.S. PATENT DOCUMENTS 5,899,811 A 5/1999 Kishibuchi et al.
6,123,514 A * 9/2000 Kawaguchi et al. ..... 417/222.2
6,352,416 B1 * 3/2002 Ota et al. ..... 417/222.2
6,589,020 B2 * 7/2003 Kimura et al. ..... 417/222.2
6,679,078 B2 * 1/2004 Yoshida et al. ..... 62/228.3
6,823,687 B2 * 11/2004 Fukumi et al. ..... 62/228.5
6,848,262 B2 * 2/2005 Nosaka ..... 62/115
2001/0003573 A1 * 6/2001 Kimura et al. ..... 417/222.2
2002/0001524 A1 * 1/2002 Fujii et al. ..... 417/222.2
2002/0144512 A1 * 10/2002 Fukanuma et al. ..... 62/228.3
2002/0157410 A1 * 10/2002 Suitou et al. ..... 62/228.3
2003/0021698 A1 * 1/2003 Umemura et al. ..... 417/222.2
2003/0029181 A1 * 2/2003 Terauchi ..... 62/228.5
2003/0035733 A1 * 2/2003 Hirota ..... 417/222.2
2003/0044289 A1 * 3/2003 Matsuda et al. ..... 417/213
2003/0044291 A1 * 3/2003 Umemura et al. ..... 417/222.2

* cited by examiner

*Primary Examiner*—William H. Rodriguez
(74) *Attorney, Agent, or Firm*—Posz Law Group, PLC

(57) ABSTRACT

A limiter device is provided in a variable displacement compressor capable of varying a discharge displacement per revolution and compressing a fluid in a cycle. The limiter device includes an operating characteristic acquiring means for acquiring a predetermined characteristic during a compression operation of the compressor, and a varying means for varying the discharge displacement of the compressor to a minimum side when the predetermined characteristic obtained by the operating characteristic acquiring means exceeds a predetermined value. Thus, the limiter device can prevent the compressor from being brought into trouble such as locking and can protect a driving belt and other auxiliary equipment on a side of an engine, while it is unnecessary to provide a pulley with a limiter function.

14 Claims, 11 Drawing Sheets

LIMITER DEVICE FOR VARIABLE DISPLACEMENT COMPRESSOR

CROSS REFERENCE TO RELATED APPLICATION

This application is based on Japanese Patent Applications No. 2003-44743 filed on Feb. 21, 2003, and No. 2003-108117 filed on Apr. 11, 2003, the disclosure of which is incorporated herein by reference.

FIELD OF THE PRESENT INVENTION

The present invention relates to a limiter device that is suitably used for a variable displacement compressor disposed in, for example, a refrigerant cycle system for a vehicle.

BACKGROUND OF THE PRESENT INVENTION

A limiter device provided in a conventional variable displacement compressor is described in JP-A-9-292003, for example. This limiter device includes a first holding member fixed to a rotary shaft of a compressor, a second holding member fixed to a pulley, and a rubber elastic member interposed in a compressed state between the first holding member and the second holding member. A driving force from the pulley is transmitted to the rotary shaft of the compressor via the elastic member during a normal operation to operate the compressor. At this time, the torque fluctuations of the compressor are absorbed by the elastic member. On the other hand, in a case where the compressor is locked because of seizure or the like, the torque of the rotary shaft exceeds a torque during the normal operation. As a result, the elastic member is deformed or broken between the first and second holding members to intercept the transmission of the driving force from the pulley to the rotary shaft of the compressor. This prevents a breakage of a driving belt connected from an engine to the pulley and protects the other auxiliary equipment associated with the engine and connected to the driving belt at the same time.

However, when a slip is caused between the driving belt and the pulley, a slip toque becomes very small in some cases, depending on the tension and the angle of contact of the driving belt connected to the pulley. This extremely reduces a design range for providing the limiter device with a connection function during the normal operation and for breaking the limiter device before causing the slip. Therefore, there are cases where it is difficult to secure the viability of the limiter device.

Further, this limiter device protects the driving belt and the other auxiliary equipment associated with the engine when a trouble such as locking or the like occurs in the compressor, but does not have a design principle of protecting the compressor itself in advance.

SUMMARY OF THE PRESENT INVENTION

In view of the above problems, it is an object of the present invention to provide a limiter device for a variable displacement compressor, which can eliminate the need for providing a pulley with a limiting function and avoid the locking of the compressor itself and protect a driving belt.

According to the present invention, a limiter device is provided in a variable displacement compressor capable of varying a discharge displacement per revolution and compressing a fluid in a cycle. Further, the limiter device includes an operating characteristic acquiring means for acquiring a predetermined characteristic during a compression operation of the compressor, and a varying means for varying the discharge displacement to a minimum side when the predetermined characteristic obtained by the operating characteristic acquiring means exceeds a predetermined value. That is, when the predetermined characteristic obtained by the operating characteristic acquiring means has signs of abnormal operation of the compressor, the varying means changes the discharge displacement of the compressor to the minimum side. Thus, it can prevent the compressor from being brought into trouble such as locking, and it can protect a driving belt and the other auxiliary equipments of an engine. Accordingly, the compressor itself can be protected before it is brought to a fatal trouble such as locking or the like, so it can be repaired and reused.

Preferably, the operating characteristic acquiring means is a sensor for detecting at least one of a temperature or a vibration at a predetermined portion of the compressor, a quantity of worn powder flowing in the compressor with the fluid, a sliding position of a compression member of the compressor, and a discharge side pressure of the compressor. In this case, the varying means is a solenoid valve that has a current supplied thereto adjusted in response to a detection signal from the sensor and opens or closes a part of a communication passage of the fluid in the compressor to vary the discharge displacement.

For example, the sensor is for detecting the quantity of the worn powder, and is constructed of a positive pole part and a negative pole part. Further, the positive pole part and the negative pole part have tips that are disposed in the compressor, and are arranged to have a predetermined potential difference therebetween. In this case, the positive pole part is separated from the negative pole part in such a manner that they are brought into conduction when a predetermined amount of the worn powder adheres to them. Therefore, the predetermined amount of the worn powder can be readily detected. Here, a plurality of the positive pole parts and a plurality of the negative pole parts can be provided in an inner peripheral direction of the compressor, or can be provided continuously in the inner peripheral direction of the compressor.

Preferably, the operating characteristic acquiring means is a temperature fuse that fuses and blows out when a temperature at a predetermined portion of the compressor exceeds the predetermined value during the compression operation, and the varying means is a solenoid valve that has a current supplied thereto via the temperature fuse and is adjusted to open or close a part of communication passage of the fluid in the compressor to vary the discharge displacement. Even in this case, the solenoid valve varies the discharge displacement of the compressor to the minimum side when the current becomes zero. Thus, expensive sensors are not required while the compressor can be protected. For example, the minimum side of the discharge displacement of the compressor is a zero side.

The limiter device of the present invention can be suitably used for a swash plate type compressor in which a slanting angle of a swash plate received in a swash plate chamber is adjusted to vary the discharge displacement.

BRIEF DESCRIPTION OF THE DRAWINGS

Other objects, features and advantages of the present invention will become more apparent from the following detailed description made with reference to the accompanying drawings, in which.

DETAILED DESCRIPTION OF THE PREFERRED EMBODIMENTS

First Embodiment

Figure 1:
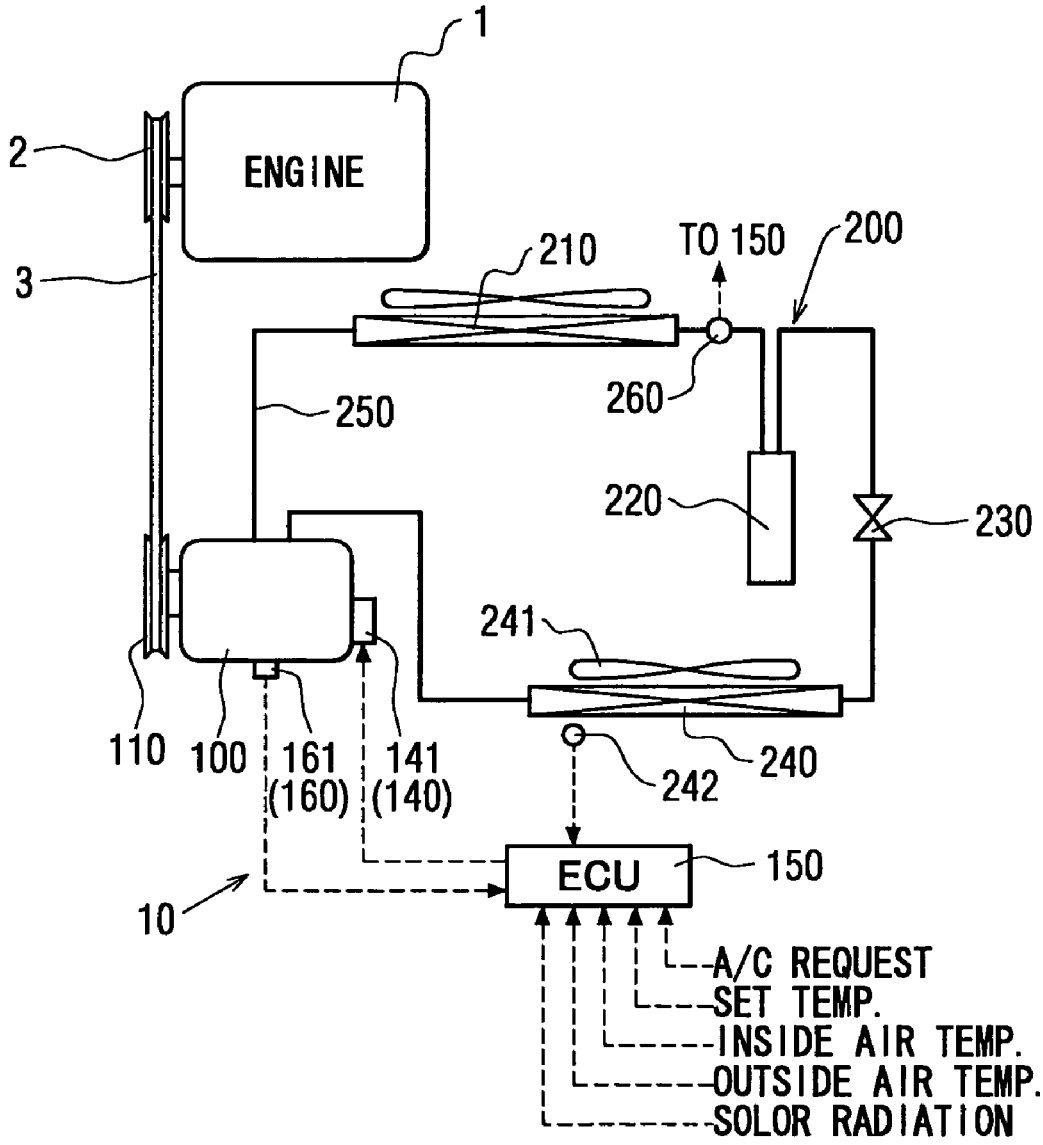
FIG. 1 is a schematic diagram showing a general construction of a refrigerant cycle system including a compressor having a limiter device in accordance with a first embodiment of the present invention.
Figure 2:
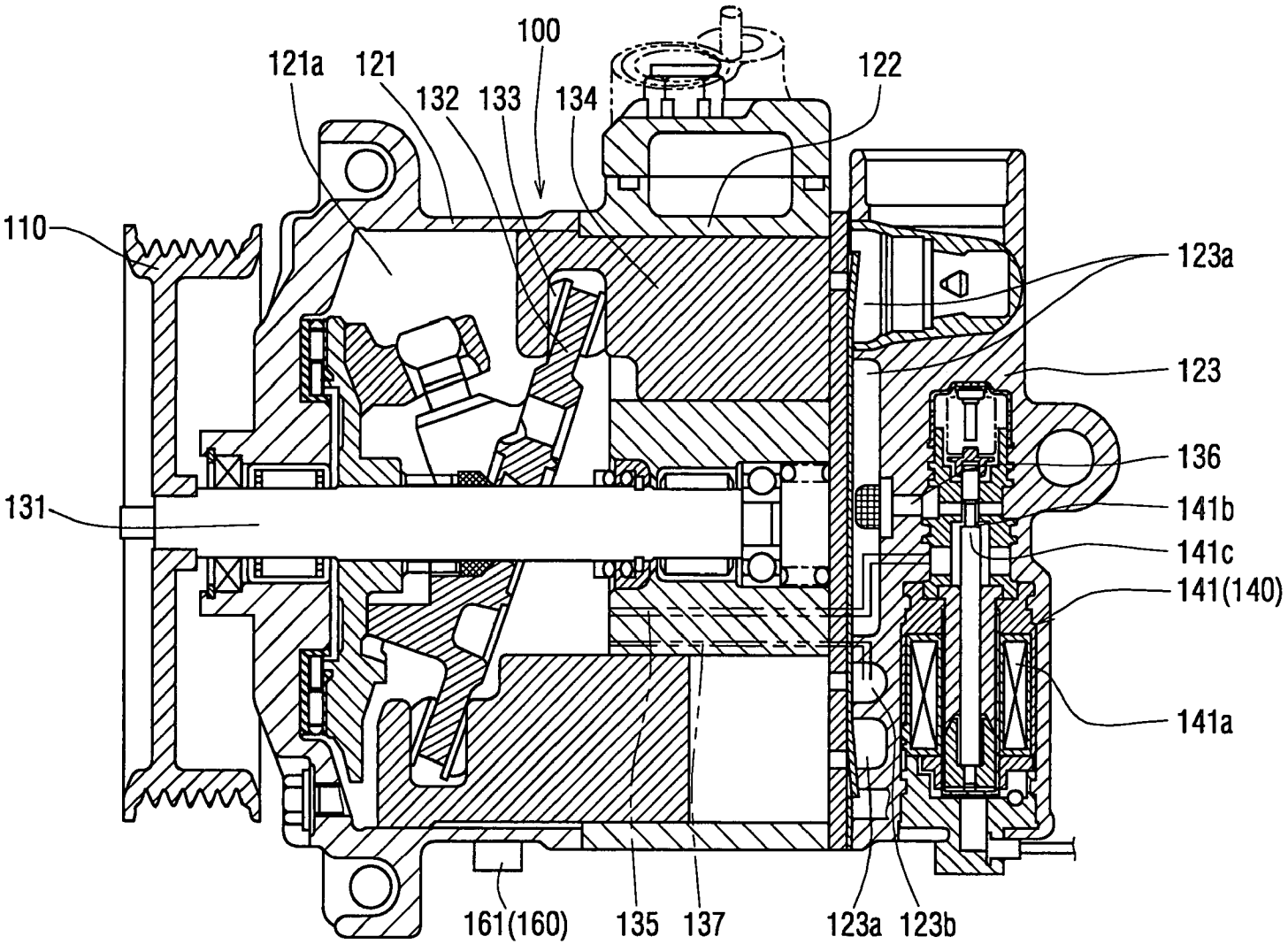
FIG. 2 is a cross-sectional view showing the compressor according to the first embodiment.

The first embodiment of the present invention will be now described with reference to FIGS. 1-3.

A limiter device 10 is constructed of a solenoid valve 141 provided in a variable displacement compressor 100 of a refrigerant cycle system, a housing temperature sensor 161, and a control unit 150. The limiter device 10 determines abnormalities during an operation of the variable displacement compressor 100 and protects the variable displacement compressor 100.

The refrigerant cycle system 200 further includes a condenser 210 for liquefying and condensing a refrigerant (fluid) compressed by the variable displacement compressor 100, a liquid reservoir 220 for separating the condensed refrigerant into gas refrigerant and liquid refrigerant, an expansion valve 230 for adiabatically expanding the liquid refrigerant flowing from the liquid reservoir 220, an evaporator 240 that evaporates the expanded refrigerant from the expansion valve 230 to cool air sent from a blower fan 241 by using the latent heat of evaporation, and a refrigerant piping 250 for connecting these parts in succession. A post-evaporator temperature sensor 242 is provided on a downstream air side of the evaporator 240, and a pressure sensor 260 is provided on a downstream refrigerant side of the condenser 210. A temperature signal and a pressure signal detected by the respective sensors 242, 260 are inputted to the control unit 150 to be described later.

The compressor 100 is operated by a driving force of a vehicle engine 1 to compress the refrigerant in a refrigerant cycle to high temperature and high pressure. The compressor 100 is a variable displacement compressor of a well-known swash plate type in which a discharge quantity, that is, a discharge displacement per one revolution can be varied by the control unit 150 and the solenoid valve 141.

To be more specific, a swash plate 132 provided on a shaft 131 is arranged in a swash plate chamber 121*a* formed by a front housing 121 and a middle housing 122. Plural pistons 134 are jointed via shoes 133 to an outer peripheral portion of this swash plate 132. Here, a pulley 110 is fixed to a tip of the shaft 131 on a side of the front housing 121. The pulley 110 is connected to a crank pulley 2 of the engine 1 by a driving belt 3 and is rotated by the driving force of the engine 1 to rotate the shaft 131.

Moreover, a rear housing 123 is provided with a solenoid valve 141 for adjusting a pressure Pc of the swash plate chamber 121*a*. A valve body 141*c* is provided in the solenoid valve 140. When a coil 141*a* is supplied with a current from the control unit 150 to be described later, the valve body 141*c* slides in a longitudinal direction and opens or closes an opening 141*b*. As the current supplied to the coil 141*a* increases, the valve body 141*c* slides closer to a side which closes the opening 141*b*.

A space where the valve body 141 is received communicates with the swash plate chamber 121*a* through a communication passage (a part of fluid passage) 135. A space opposed to the valve body 141*c* communicates with a discharge chamber (discharge side) 123*a* through a communication passage (a part of fluid passage) 136. The swash plate chamber 121*a* communicates with a suction chamber (suction side) 123*b* through an exhaust passage (a part of fluid passage) 137.

When the opening 141*b* is opened by the valve body 141*c*, the swash plate chamber 121*a* communicates with the discharge chamber 123*a* and a pressure Pd in the discharge chamber 123*a* is increased by the pressure Pc in the swash plate chamber 121*a*. Then, the swash plate 132 is moved to a side vertical to the shaft 131 to reduce the stroke of the piston 134 and to decrease the discharge displacement of the compressor 100. When the swash plate 132 is moved to a nearly vertical slanting state, the discharge displacement of the compressor 100 becomes a minimum (nearly zero). On the contrary, when the valve body 141*c* closes the opening 141*b*, a communication between the swash plate chamber 121*a* and the discharge chamber 123*a* is shut off and the pressure Pc in the swash plate chamber 121*a* leaks through the exhaust passage 137 to the suction chamber 123*b* where pressure (Ps) is low. Then, the pressure Pc in the swash plate chamber 121*a* is reduced to largely slant the swash plate 132, as shown in FIG. 2. In this case, the stroke of the piston 134 is increased, thereby increasing the discharge displacement of the compressor 100.

The solenoid valve 141 operated by the control unit 150 corresponds to varying means (140) of the present invention.

A housing temperature sensor 161 used as the operating characteristic acquiring means (160) 160 of the present invention is provided on a side wall of the front housing 121 and detects a surface temperature of the front housing 121 due to heat produced in the front housing 121 when the compressor 100 is operated. The housing temperature sensor 161 is provided at a position corresponding to such a portion near the swash plate 132 in the front housing 121 that most evolves heat when the compressor 100 is brought into a trouble such as locking. A temperature signal detected by the housing temperature sensor 161 is inputted to the control unit 150.

The control unit 150 controls the discharge displacement of the compressor 100 on the basis of a pressure signal from the above pressure sensor 260, a temperature signal from the post-evaporator temperature sensor 242 and a temperature signal from the housing temperature sensor 161. In addition to these signals, the control unit 150 controls the discharge displacement on the basis of signals of an A/C request, a set temperature, an inside air temperature, an outside air temperature, a solar radiation and the like which are inputted from operating switches for an occupant and sensors provided on predetermined positions of a vehicle (not shown).

Next, operation of the limiter device based on the above construction will be described. The control unit 150 calculates a target evaporator temperature Teo from a calculation formula predetermined by the use of the signals of the set temperature, the inside air temperature, the outside air temperature and the solar radiation. The control unit 150 controls the discharge displacement of the compressor 100 such that an actual temperature Te of air cooled by the evaporator 240 (post evaporator temperature obtained by the post-evaporator temperature sensor 242) becomes the above target evaporator temperature Teo. That is, the control unit 150 determines a current value to be supplied to the solenoid valve 141 and supplies the current value. In this respect, when the pressure signal from the pressure sensor 260 exceeds a predetermined high-pressure side pressure PdH, the control unit 150 changes the discharge displacement of the compressor 100 to a minimum side to protect the refrigerant cycle system 200.

Figure 3:
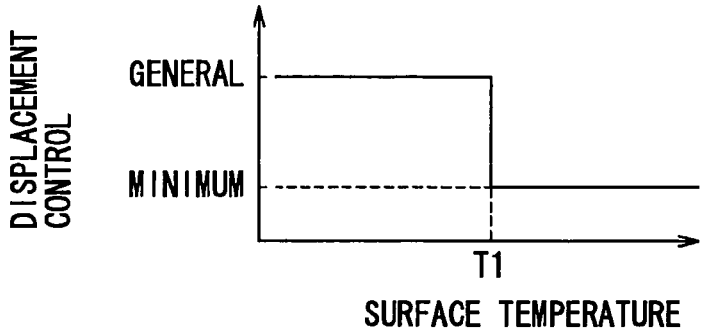
FIG. 3 is a control characteristic graph showing a relationship between a housing surface temperature and a discharge displacement control according to the first embodiment.

When the surface temperature of the front housing 121 obtained by the housing temperature sensor 161 exceeds a predetermined threshold T1 as shown in FIG. 3, the supply of current through the solenoid valve 141 is stopped to change the discharge displacement of the compressor 100 to the minimum side (nearly zero). In this respect, the threshold T1 corresponds to a predetermined value of the present invention. Further, the threshold T1 is determined as a temperature which is thought to bring the compressor 100 into the locking trouble and the like with respect to a temperature when the compressor 100 is operated under normal conditions.

Figure 19A:
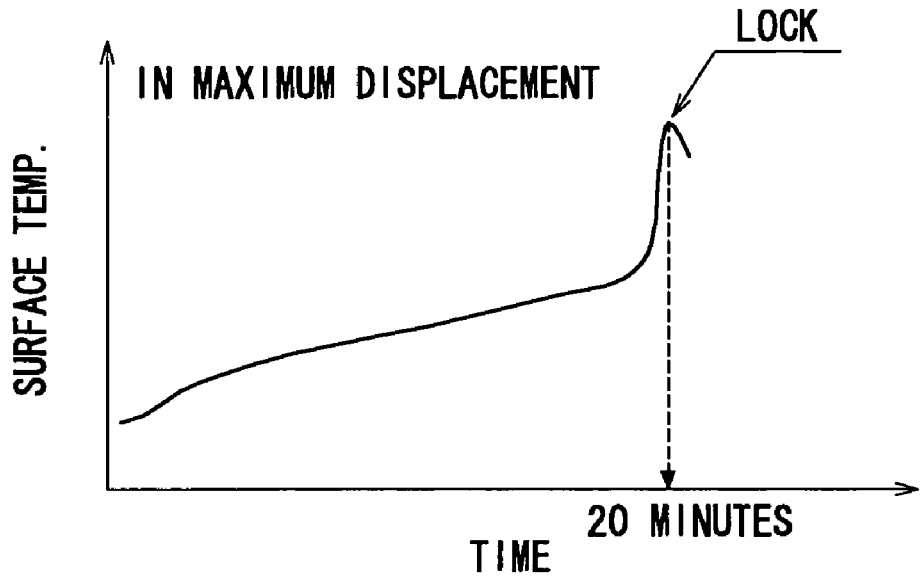
FIG. 19A is a graph showing a housing surface temperature at a maximum discharge displacement of a compressor.
Figure 19B:
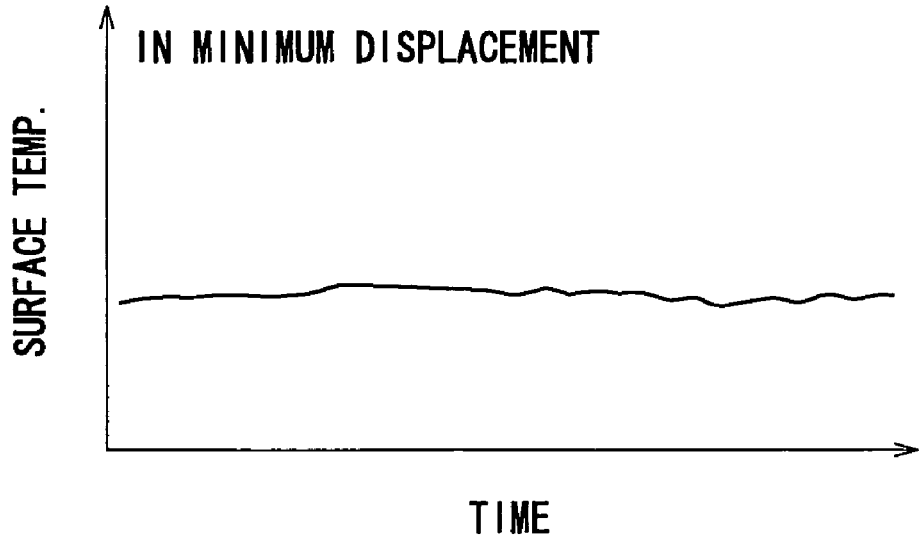
FIG. 19B is a graph showing a housing surface temperature at a minimum discharge displacement of the compressor, in experiments performed by the inventors of the present invention.

FIG. 19A is a graph showing a housing surface temperature at a maximum discharge displacement of a compressor, and FIG. 19B is a graph showing the housing surface temperature at a minimum discharge displacement of the compressor, in experiments performed by the inventors of the present invention. The present inventors made a close inspection of a part causing a trouble of locking of a variable displacement compressor on the market and carried out a test of duplicating the trouble and obtained the following findings. That is, a foreign matter left in a refrigeration cycle or in the compressor is thought as one of factors to bring the compressor into the trouble of locking. Hence, in the experiments in FIGS. 19A and 19B, alumina powder (3 g) is intentionally applied to the sliding portion of the compressor (in the case of a swash plate type compressor, a swash plate and shoes) and the compressor is cycle-operated (a refrigeration cycle is formed and the compressor is operated at 2,000 rpm), whereby results shown in FIG. 19A and FIG. 19B are obtained.

That is, in this case, when the compressor is operated at a maximum discharge displacement (FIG. 19A), the alumina power is bit into a sliding portion to cause locking for 20 minutes to duplicate a phenomenon of shaving a swash plate. At this time, it can be recognized that the biting of the alumina power increases operating torque and causes heat to increase temperature on the surface of a compressor housing, thereby finally causing an abrupt change in the temperature.

On the other hand, when the compressor is operated at a minimum discharge displacement (FIG. 19B) in this experiments, even after the compressor is continuously operated for 12 hours, the compressor is neither brought to a locking state nor developed the temperature increase described above. From this experiments, the inventors found that by adjusting the discharge displacement appropriately while keeping track of some signs shown by the compressor before it is brought to the locking state, the compressor itself can be protected.

Thus, according to the first embodiment of the present invention, as described above, when the temperature of the front housing 121 shows an abnormal sign that it exceeds the threshold T1, the discharge displacement of the compressor 100 is varied to the minimum side so that the operating torque of the compressor 100 is changed to the minimum side. Hence, it can prevent the compressor 100 from being brought into trouble such as locking, and it can protect the driving belt 3 of the engine 1 side and the other auxiliary equipment of the engine 1.

Further, because the present invention can eliminate the need for providing the pulley with a limiter device function, the present invention can reduce costs relating to design and manufacture of the compressor 100 with the limiter device.

Still further, the compressor 100 itself can be protected before it is brought to a fatal trouble such as locking or the like, so it can be repaired and reused.

In this embodiment of the present invention, the surface temperature of the front housing 121 is acquired as an absolute value by using the housing temperature sensor 161, to prevent the trouble such as locking of the compressor 100. However, by the use of a change of a surface temperature per a predetermined period of time, that is, a rate of change in the surface temperature of the compressor 100, the discharge displacement of the compressor 100 can be controlled to the minimum side. Specifically, when the change rate of the surface temperature of the compressor 100 exceeds a predetermined change rate of the surface temperature (threshold) of the compressor 100, the discharge displacement of the compressor 100 can be also varied to the minimum side. Even in this case, the same advantages described above can be obtained.

Second Embodiment

Figure 4:
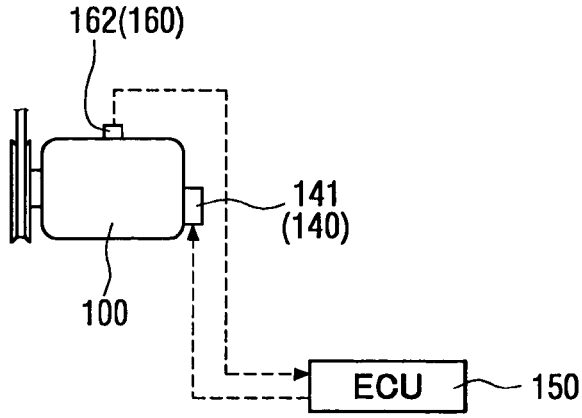
FIG. 4 is a schematic diagram showing a limiter device according to a second embodiment of the present invention.

The second embodiment of the present invention will be now described with reference to FIG. 4.

In the second embodiment, a vibration pickup 162 for acquiring vibrations G during the operation of the compressor 100 is used as the operating characteristic acquiring means (160).

When the compressor 100 is brought to a state of locking or the like, it shows a sign of deterioration of vibrations in the sliding parts of the swash plate 132, the shoes 133 and the like. Therefore, a threshold G1 is previously determined for vibration G detected by the vibration pickup 162. Further, when the vibration G exceeds the threshold G1, the discharge displacement of the compressor 100 is varied to the minimum side by the solenoid valve 141. Thus, the same effect as in the first embodiment can be produced.

Also in the second embodiment, as described in the first embodiment, by the use of a change rate in vibration G in place of the absolute value of the vibration G, the discharge displacement of the compressor 100 can be controlled. That is, when the change rate in vibration exceeds a predetermined change rate of the vibration G, the discharge displacement of the compressor 100 can be varied to the minimum side.

Third Embodiment

The third embodiment of the present invention will be now described with reference to FIGS. 5A-6B.

In the third embodiment, an electromagnetic pickup (sensor) 163 for acquiring a sliding position of a compression member, that is, the piston 134 during the operation of the compressor 100 is used as the operating characteristic acquiring means (160).

When the compressor 100 is brought to a state of locking or the like, it shows a sign of the swash plate 132 being shaved between the swash plate 132 and the shoes 133. Therefore, in this embodiment, a position shift of a top dead center of the piston 134 connected to the swash plate 132 is acquired.

Figure 5A:
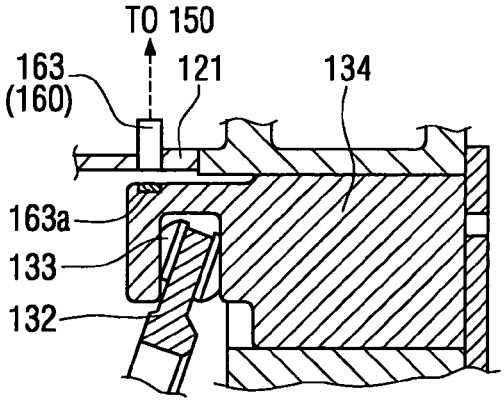
FIGS. 5A and 5B are cross-sectional views showing a position of a piston in a normal operation and in an abnormal operation, respectively, according to a third embodiment of the present invention.
Figure 6A:
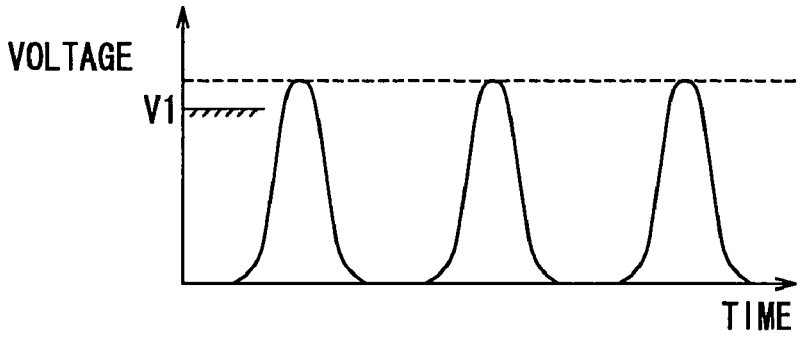
FIGS. 6A and 6B are graphs showing a detection voltage of an electromagnetic pickup in a normal operation and in an abnormal operation, respectively, according to the third embodiment.

As shown in FIG. 5A, a magnet 163*a* is buried in the end of the piston 134 and the electromagnetic pickup 163 is fixed to the front housing 121 so as to respond to the magnet 163*a* when the piston 134 is at the top dead center. The electromagnetic pickup 163, as shown in FIG. 6A, outputs an electromotive force (voltage) V generated by a change in magnetic flux of the magnet 163*a* caused by the reciprocating movement of the piston 134.

Figure 5B:
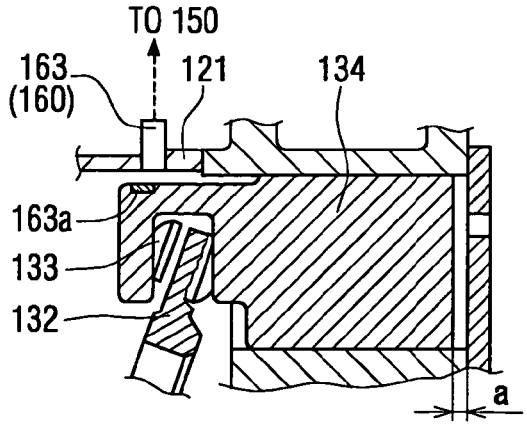
Figure 6B:
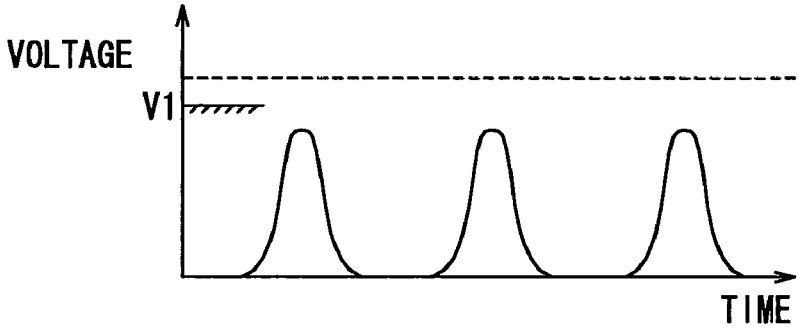

When the swash plate 132 is shaved as the sign of locking or the like of the compressor 100, as shown in FIG. 5B, a clearance "a" at the top dead center of the piston 134 is increased by the same amount of shavings. Therefore, the position of the magnet 163*a* is shifted with respect to the electromagnetic pickup 163 in a left direction in the drawing. Then, as shown in FIG. 6B, the voltage V developed at the electromagnetic pickup 163 is decreased. Further, when the voltage V becomes smaller than a predetermined threshold V1, the discharge displacement of the compressor 100 is varied to the minimum side by the solenoid valve 141. Thus, the same advantages as in the first embodiment can be produced.

Fourth Embodiment

Figure 7:
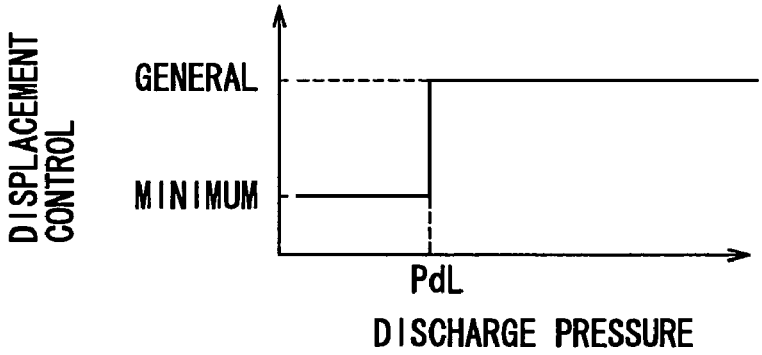
FIG. 7 is a control characteristic graph showing a relationship between a discharge side pressure and discharge displacement in a compressor, according to a fourth embodiment of the present invention.

The fourth embodiment of the present invention will be now described with reference to FIG. 7.

In the fourth embodiment, a pressure sensor 260 (FIG. 1) for detecting the discharge side pressure Pd of the compressor 100 during the operation of the compressor 100 is used as the operating characteristic acquiring means (160).

As described in the first embodiment, the pressure sensor 260 is provided originally to protect the refrigerant cycle system 200 when the discharge side pressure Pd exceeds the high pressure side pressure PdH. However, in this embodiment, by the use of the pressure sensor 260, the discharge displacement of the compressor 100 is varied to the minimum side in a case where the discharge side pressure Pd is lower than a low pressure side threshold PdL in the refrigerant cycle system 200.

When the quantity of refrigerant filled in the refrigerant cycle unit 200 is smaller than an essential quantity of refrigerant, the discharge side pressure Pd becomes lower than the low pressure side threshold PdL. When the compressor 100 is operated in a state where the quantity of refrigerant filled is small, the cooling capacity of the evaporator 240 becomes insufficient. In this case, the compressor 100 needs always to be operated at the maximum side discharge displacement. The extremely high frequency of operation at high load may bring the compressor 100 into the trouble such as locking. In the fourth embodiment, it can previously protect the compressor 100 from being brought to this state.

Fifth Embodiment

The fifth embodiment of the present invention will be now described with reference to FIGS. 8-12.

In the fifth embodiment, a worn powder detection sensor 167 for detecting worn powder (abraded powder) produced on respective sliding portions in the compressor 100 is used as the operating characteristic acquiring means (160).

Figure 8:
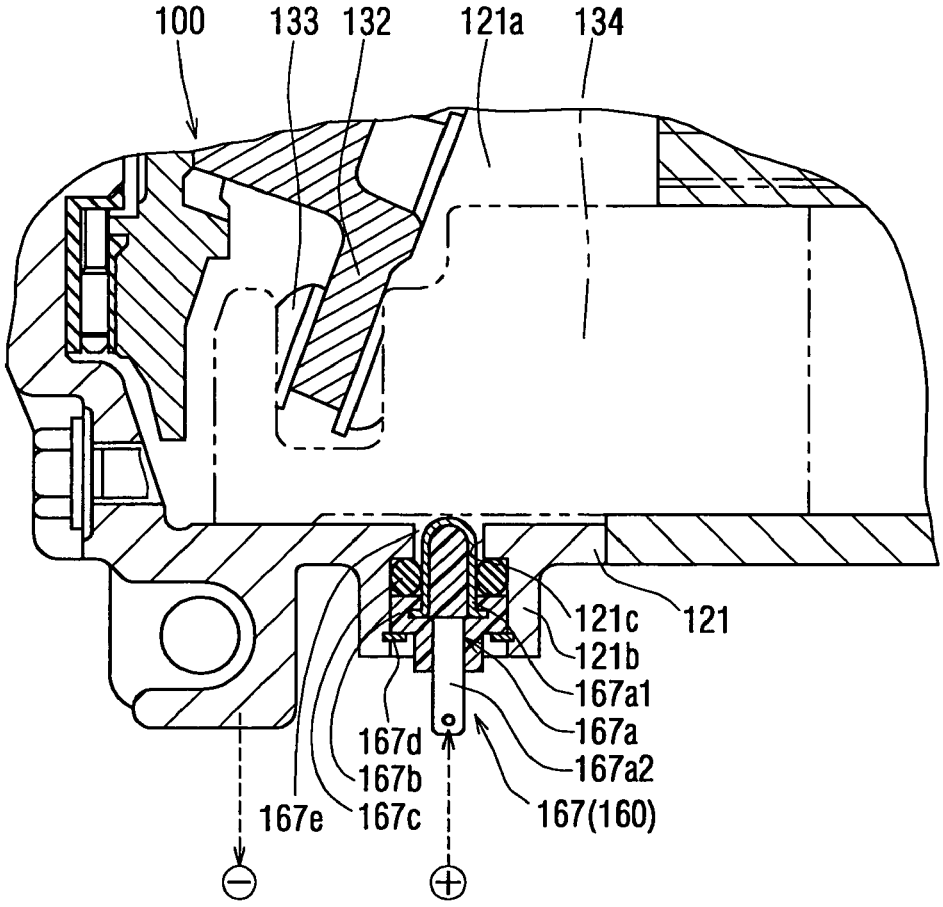
FIG. 8 is a partial cross-sectional view of a compressor, showing a construction of a limiter device according to a fifth embodiment of the present invention.

The worn powder detection sensor 167, as shown in FIG. 8, includes an electrode member 167*a* provided in the front housing 121 at a position which is near and corresponds to the swash plate 132 and is between the pistons 134. The front housing 121 has a support 121*b* which is open to the outside and is shaped like a cylinder. A hole 121*c* communicating with the swash plate chamber 121*a* in the compressor 100 is formed in the bottom side of the support 121*b*.

The electrode member 167*a* is constructed of a circular column part 167*a*1 which is open at one end and deeply drawn in the shape of a cylinder, and a connecting part 167*a*2 which is integrated with the circular column part 167*a*1 and extends from the open end side of this circular column part 167*a*1 to a side opposite to the circular column part 167*a*1. A resin part 167*b* as an insulating member is provided in the middle of the electrode member 167*a*. In the electrode member 167*a*, the circular column part 167*a*1 is inserted into the hole 121*c* and an O-ring 167*c* is interposed between the circular column part 167*a*1 and the inner peripheral wall of the support part 121*b*, whereby the electrode member 167*a* is fixed to the support part 121*b* by a stopper 167*d*. In place of fixing the electrode member 167*a* by the stopper 167*d*, the support part 121*b* and the resin part 167*b* are threaded and the resin part 167*b* is screwed into the support part 121*b* to fix the electrode member 167*a* to the support part 121*b*.

A small clearance 167*e* is formed between the cylindrical column part 167*a*1 and the hole 121*c*. A predetermined potential difference is applied between the connecting part 167*a*2 and the front housing 121 while the connecting part 167*a*2 is at a plus side and the front housing 121 is at a minus side. The electrode member 167*a* corresponds to a positive pole part of the present invention and the front housing 121 corresponds to a negative pole part of the present invention.

Figure 9:
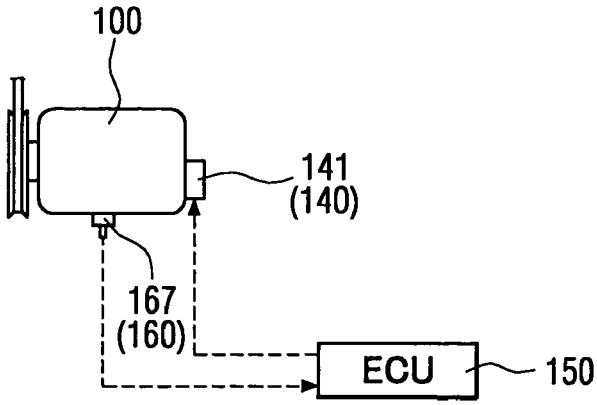
FIG. 9 is a schematic diagram showing the limiter device of the fifth embodiment.

As will be described later, when electric current flows between the electrode member 167*a* and the front housing 121, as shown in FIG. 9, the electric current is outputted as a current signal to the control unit 150. A timing when this current signal is outputted corresponds to a timing when a predetermined characteristic exceeds a predetermined value in the present invention.

In this embodiment, the worn powder detection sensor 167 is operated in the following manner. That is, as signs when the compressor 100 is brought the state of locking, it produces the worn powder of shavings between the swash plate 132 and the shoes 133. With the progression of shaving, the worn powder adheres to the small clearance 167*e*, that is, the electrode member 167*a* and the front housing 121. Then, when the quantity of worn powder reaches a predetermined quantity, the electrode member 167*a* is brought into contact with the front housing 121. Thus, a current responsive to a predetermined potential difference and the resistance of the worn powder flows. Then, the control unit 150 acquires this current as the detection signal of the worn powder and actuates the solenoid valve 141 to vary the discharge displacement of the compressor 100 to the minimum side.

Thus, the sign of locking can be acquired by the worn powder detection sensor 167 that has a current passed therethrough in response to the quantity of the worn powder. By varying the discharge displacement of the compressor 100 to the minimum side, the same advantages as in the first embodiment can be produced.

The number of worn powder detection sensor 167 is not limited to one as described above, but a plurality of worn powder detection sensors 167 can be provided in the peripheral direction of the front housing 121. When the plurality of worn powder detection sensors 167 are operated, it is possible to detect the worn powder in a wider region in the compressor 100 and hence to improve detection capability.

Figure 10:
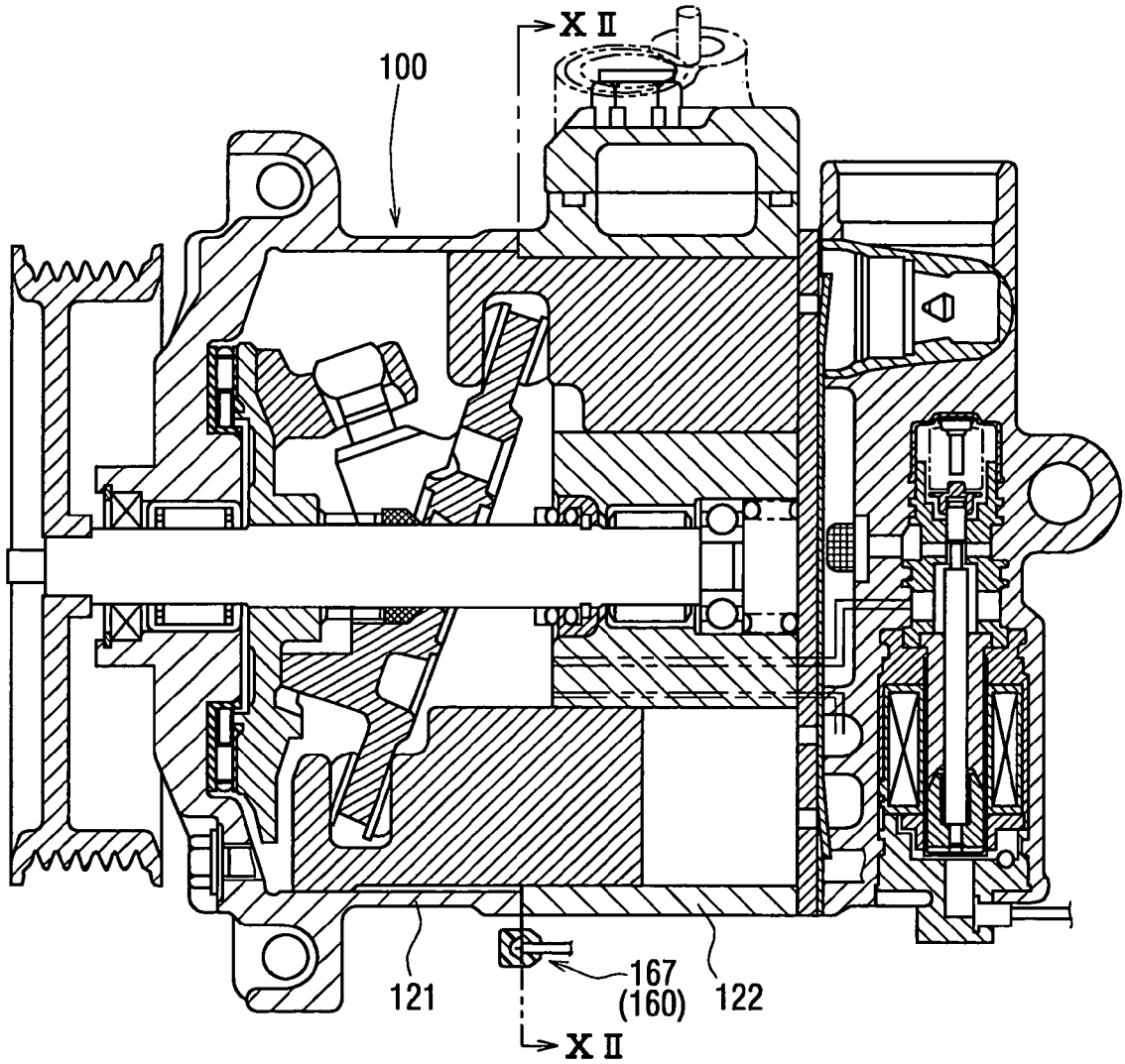
FIG. 10 is a cross-sectional view of a compressor, showing a construction of a limiter device according to a modification of the fifth embodiment.
Figure 11:
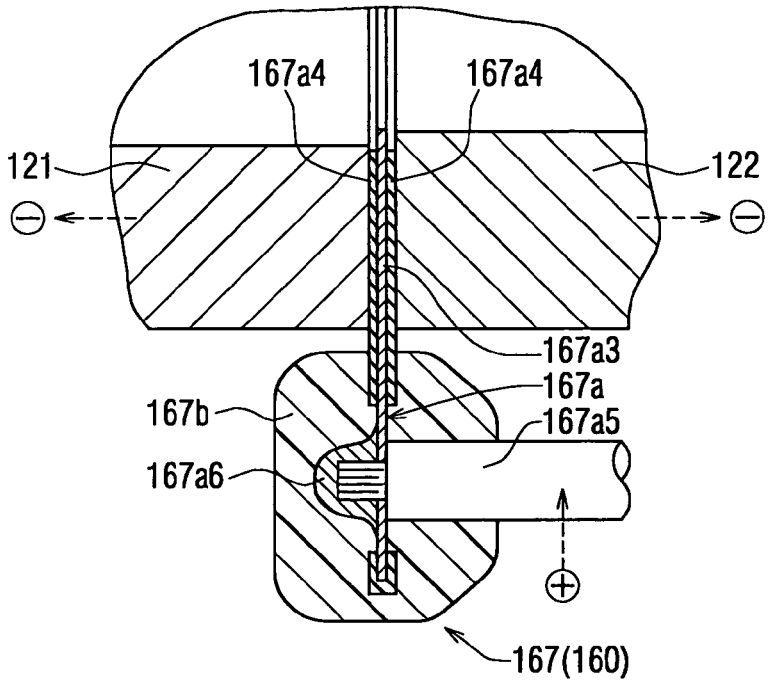
FIG. 11 is a cross-sectional view of a worn powder detection sensor in FIG. 10.
Figure 12:
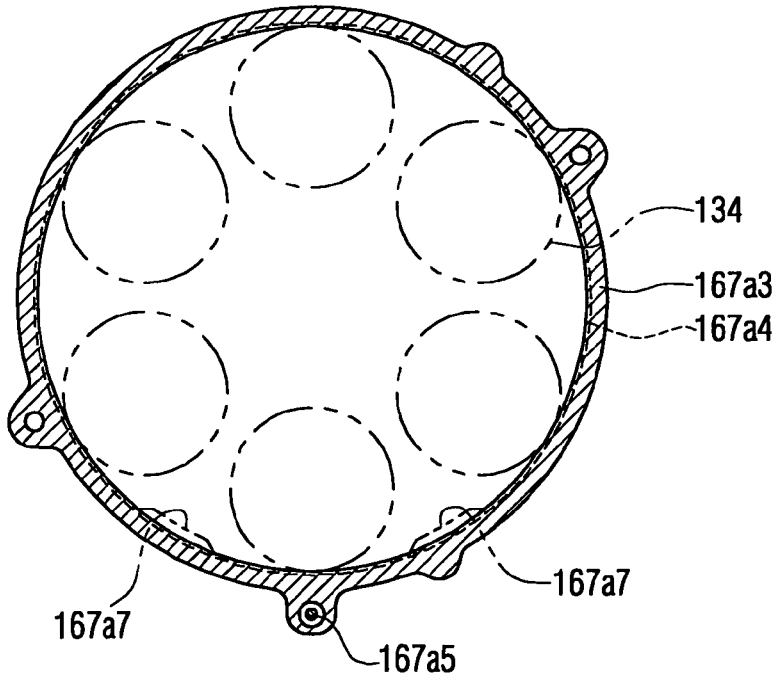
FIG. 12 is a cross-sectional view taken along the line XII-XII in FIG. 10.

Moreover, as one modification of the above fifth embodiment, the worn powder detection sensor 167 can be formed in the manner shown in FIG. 10 to FIG. 12. That is, a sheet metal 167*a*3 that is usually used as a sealing member between the front housing 121 and the middle housing 122 is also used as the electrode member 167*a*. The sheet metal 167*a*3 is a ring-shaped plate member and has a rubber member 167*a*4 on both surfaces thereof. Here, the rubber member 167*a*4 is used as an insulating member and a sealing member. A lead wire 167*a*5 is bonded to a predetermined portion in a circumferential direction of the sheet metal 167*a*3 by solder 167*a*6, and the resin part 167*b* is provided outside the lead wire 167*a*5 and the solder 167*a*6. Overhanging parts 167*a*7 overhanging to the center side, as shown by a double dot and dash line in FIG. 12, are provided at portions between the plurality of pistons 134 to acquire the worn powder in the spaces between the pistons 134. Thus, arrangement, the worn powder is attached to the sheet metal 167*a*3 and both of the housings 121 and 122.

A predetermined potential difference is applied between the lead wire 167*a*5 and the respective housings 121, 122 while the side of the lead wire 167*a*5 is at a plus side and the front housing 121 and the middle housing 122 are at a minus side.

Thus, the worn powder detection sensor 167 can be easily formed by the use of the essential structural members of the compressor 100. In addition, the worn powder can be detected in a wide region in the compressor 100 to improve detection capability, thereby preventing the compressor being brought into the trouble of locking and the like.

Further, as another modification (not shown) of the fifth embodiment, the worn powder detection sensor can be formed by fixing a part having a positive pole part and a negative pole part, which are separated by a predetermined distance between them, to the front housing 121 or the middle housing 122 via an insulating member.

As a further another modification (not shown) of the fifth embodiment, the worn powder detection sensor can be a photo-sensor for optically detecting the worn powder or an electromagnetic pickup for detecting the worn powder by a change in magnetic field when the worn powder is magnetic material.

Sixth Embodiment

Figure 13:
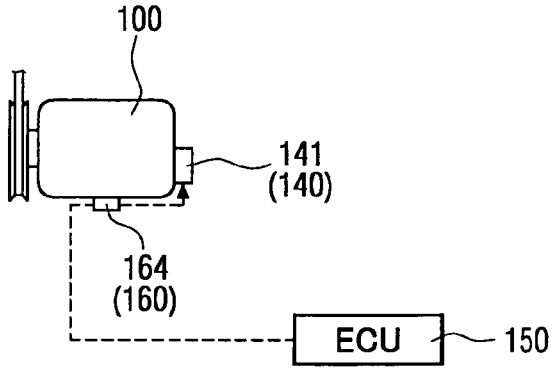
FIG. 13 is a schematic diagram showing a limiter device according to a sixth embodiment of the present invention.

The sixth embodiment of the present invention will be now described with reference to FIG. 13.

In a sixth embodiment, a temperature fuse 164 is used as the operating characteristic acquiring means (160). The solenoid valve 141 is supplied with current via the temperature fuse 164 from the control unit 150.

The temperature fuse 164 is a conductive metal that fuses (melts down) at a low melting point (here, a level of about 200° C.). To be more specific, solder made of tin and lead is suitably used as the material of temperature fuse 164. Indium, lithium, and tin can be selected for the material. The temperature fuse 164 is fixed to the same position (on the side wall of the front housing 121) as the housing temperature sensor 161 (FIG. 1) of the above first embodiment. The melting temperature Tm of the temperature fuse 164 is the same level as the threshold T1 described in the above first embodiment. This melting temperature Tm becomes a threshold for protecting the compressor 100 in this sixth embodiment.

During the normal operation of the compressor 100, the current from the control unit 150 is supplied via the temperature fuse 164 to the solenoid valve 141, whereby the discharge displacement of the compressor 100 is controlled. However, when the compressor 100 shows the signs of locking, the surface temperature of the front housing 121 is increased and the temperature fuse 164 fuses (fuses and blows out). Then, the current supplied to the solenoid valve 141 is stopped, so the valve body 141*c* opens an opening 141*b* to increase pressure Pc in the swash plate chamber 121*a*. Thus, the discharge displacement of the compressor 100 is varied to the minimum side to prevent the trouble such as locking or the like. In this case, expensive sensors described in the above first to fifth embodiments are not required while the compressor 100 can be protected.

Seventh Embodiment

Figure 14:
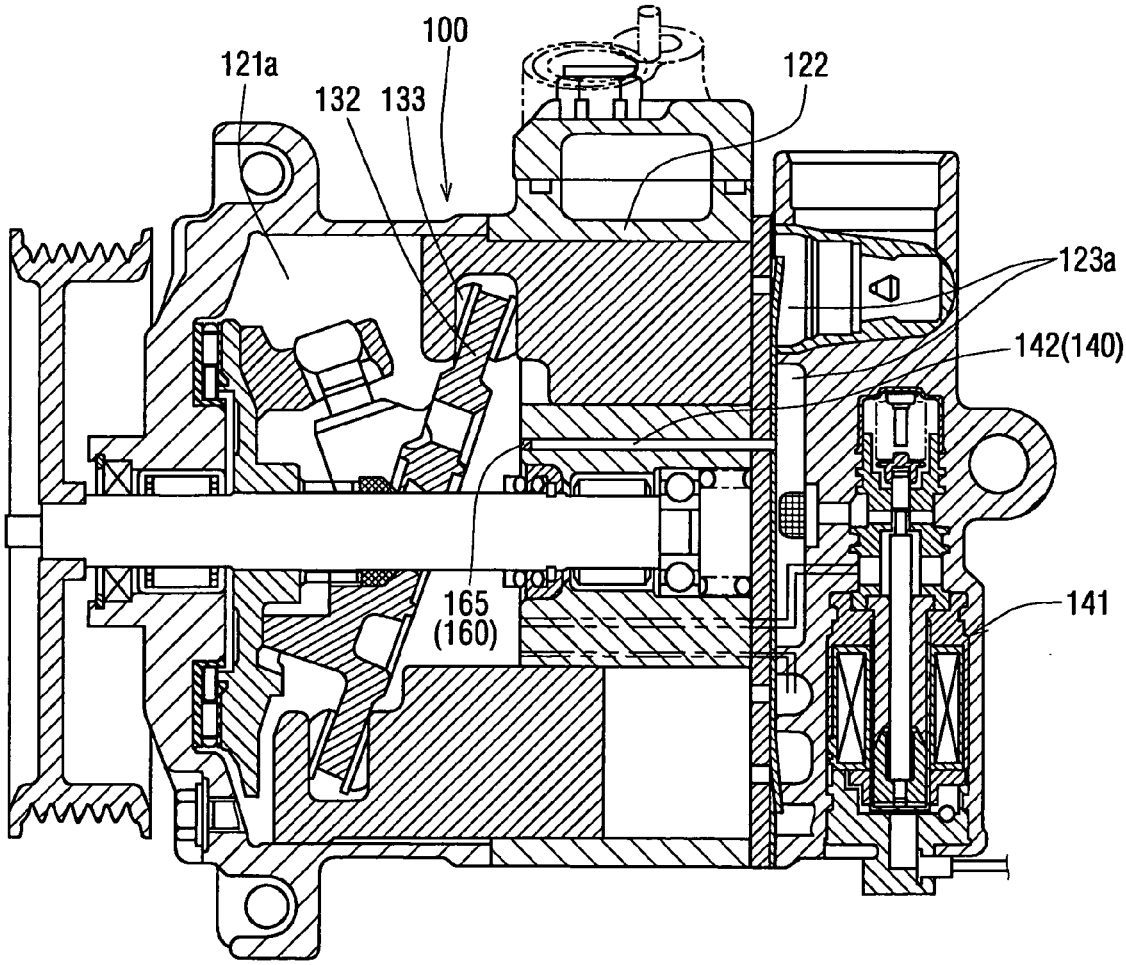
FIG. 14 is a cross-sectional view of a compressor, showing a construction of a limiter device according to a seventh embodiment of the present invention.

The seventh embodiment of the present invention will be now described with reference to FIG. 14.

In the seventh embodiment, a communication hole 142 for making the swash plate chamber 121*a* communicate with the discharge chamber 123*a* is formed in the middle housing 122 and is closed by a low-melting metal 165. The low-melting metal 165 is provided on a side of the swash plate chamber 121*a* of the communication hole 142 and melts when the inside temperature of the compressor 100 reaches the threshold Tm1 when the compressor 100 begins to show the sign of trouble. To be specific, solder, indium, lithium, and tin are suitably used as the low-melting metal 165, as in the case of the temperature fuse 164 of the above sixth embodiment.

In the seventh embodiment, the low-melting metal 165 corresponds to the operating characteristic acquiring means (160) and the release means, and the communication hole 142 corresponds to the varying means 140.

During the normal operation of the compressor 100, the discharge displacement of the compressor 100 is controlled by the solenoid valve 141 and the control unit 150. However, when the compressor 100 begins showing the signs of locking or the like, the heat evolved by the sliding portions in the swash plate 132, the shoes 133 and the like increases the inside temperature to melt the low-melting metal 165 at the threshold Tm1. Then, the closed communication hole 142 is opened so that the swash plate chamber 121*a* communicates with the discharge chamber 123*a* to increase the pressure Pc of the swash plate chamber 121*a*.

Thus, the discharge displacement of the compressor 100 is varied to the minimum side to prevent the trouble of locking or the like. Hence, as in the case with the sixth embodiment, the expensive sensors described in the above first to fifth embodiments are not required and the compressor 100 can be protected.

Eighth Embodiment

Figure 15:
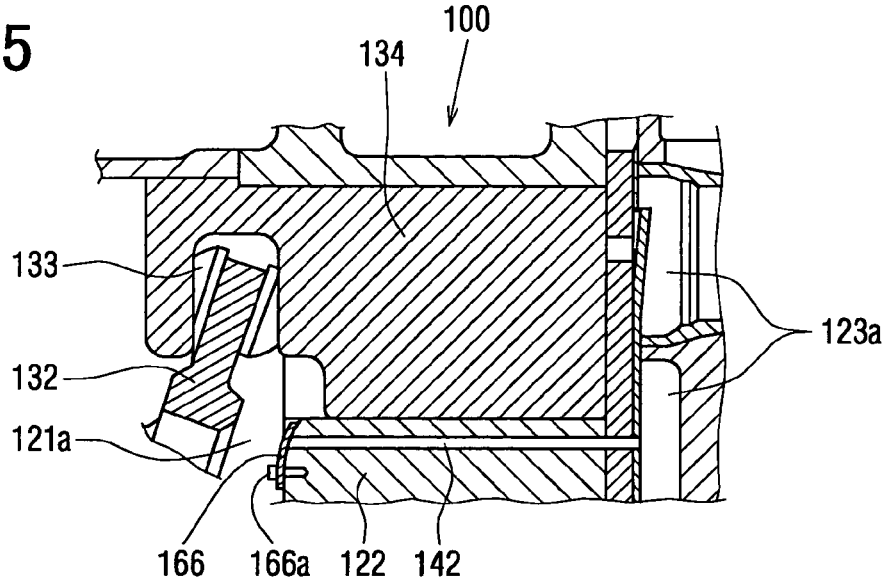
FIG. 15 is a cross-sectional view of a compressor, showing a construction of a limiter device according to an eighth embodiment of the present invention.

The eighth embodiment of the present invention will be now described with reference to FIGS. 15-17.

In the eighth embodiment, in place of the low-melting metal 165 in the above seventh embodiment, a bimetal 166 is used as the release means (the operating characteristic acquiring means).

Figure 16A:
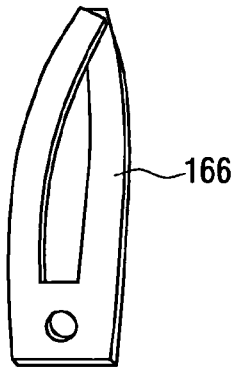
FIGS. 16A and 16B are an outer appearance view and a cross-sectional view of a bimetal, respectively, according to the eighth embodiment.
Figure 16B:
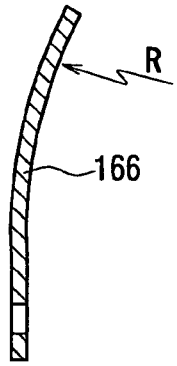
Figure 17:
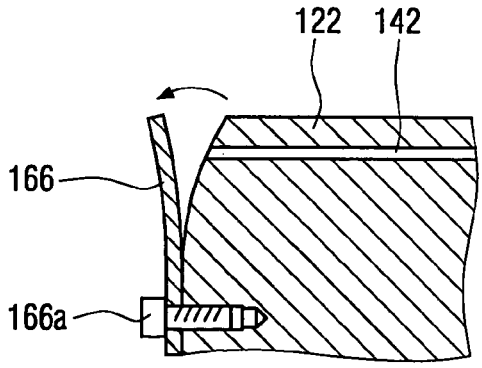
FIG. 17 is a cross-sectional view showing an operating state of the bimetal in an abnormal operation, according to the eighth embodiment.

The bimetal 166, as shown in FIG. 16A, is made by welding the tips of a bifurcated strip and, as shown in FIG. 16B, is formed in a smooth curved shape having a radius R in cross section. The bimetal 166 is fixed to the middle housing 122 by using a bolt 166*a*, and closes the opening of the swash plate 132 side of the communication hole 142 in the normal operation. Then, the deformation of the bimetal 166 finishes before the inside temperature reaches the threshold Tm1 when the compressor 100 starts showing the sign of trouble.

During the normal operation of the compressor 100, the discharge displacement of the compressor 100 is controlled by the solenoid valve 141 and the control unit 150. However, when the compressor 100 begins showing the signs of locking or the like, the heat generated by the sliding portions in the swash plate 132, the shoes 133 and the like increases the inside temperature. This deforms the bimetal 166 to the side of the swash plate chamber 121*a*, as shown in FIG. 17, before the inside temperature reaches the threshold Tm1 to open the closed communication hole 142. Then, the swash plate chamber 121*a* communicates with the discharge chamber 123*a* to increase the pressure Pc of the swash plate chamber 121*a*. When the bimetal 166 is deformed, the bimetal 166 is reversed in the original curved shape having a radius R in cross section by snap action and this reversed state is kept thereafter.

Thus, as in the case with the seventh embodiment, the discharge displacement of the compressor 100 is varied to the minimum side to prevent the trouble of locking or the like.

Ninth Embodiment

Figure 18:
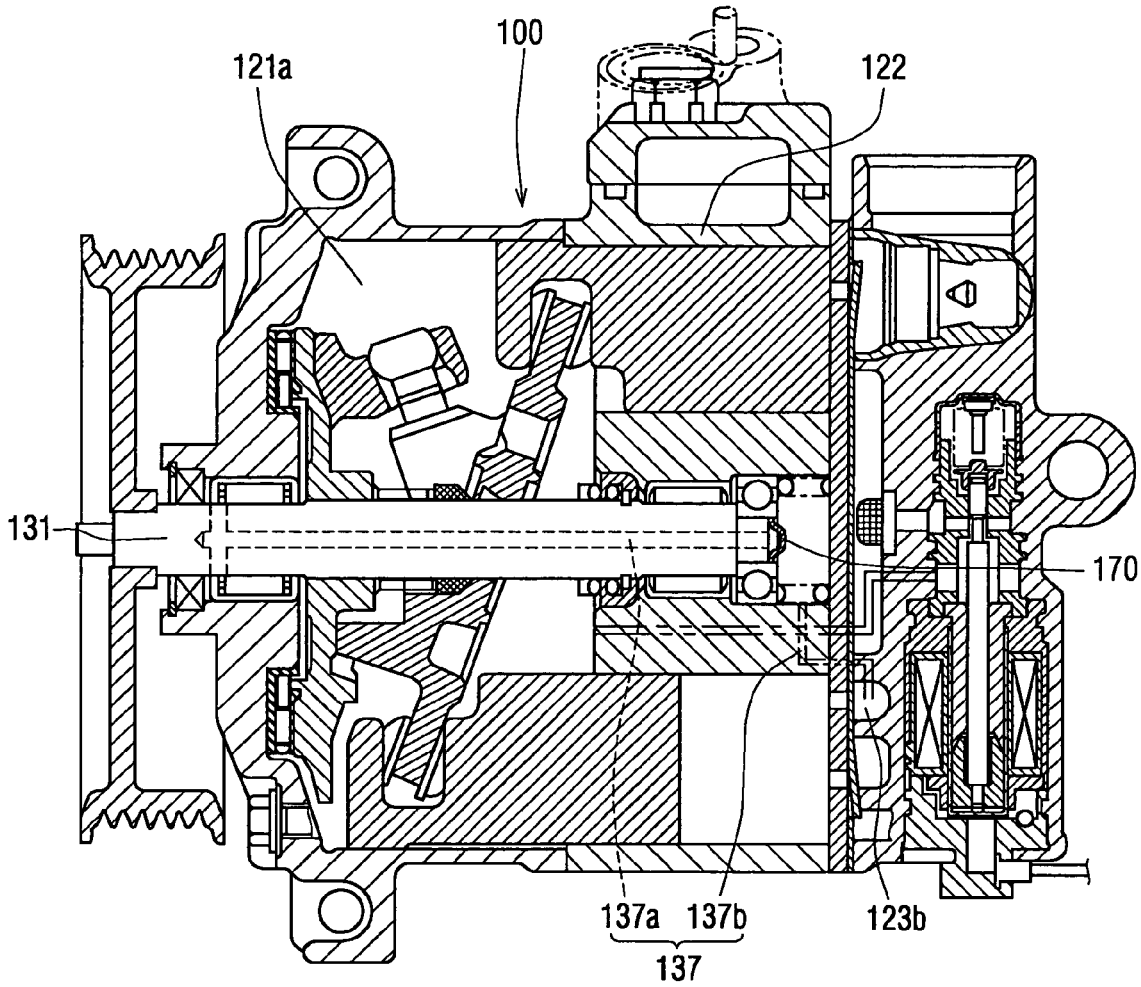
FIG. 18 is a cross-sectional view of a compressor, showing a construction of a limiter device according to a ninth embodiment of the present invention.

The ninth embodiment of the present invention will be now described with reference to FIG. 18.

In the ninth embodiment, a filter 170 is provided in the exhaust passage 137. The exhaust passage 137 is constructed of a first exhaust passage 137*a* formed in the axial center portion of the shaft 131 and a second exhaust passage 137*b* formed in the middle housing 122. Then, the filter 170 is fixed to the end of the first exhaust passage 137*a* on the side of the middle housing 122.

The filter 170 acquires mainly the worn powder produced by the respective sliding portions when the compressor 100 shows the signs of locking or the like. In this ninth embodiment, the filter 170 corresponds to both of the operating characteristic acquiring means and the varying means.

When the worn powder is produced by the respective sliding portions when the compressor 100 shows the signs of locking or the like, the worn powder flows with the refrigerant. The worn powder flowing into the swash plate chamber 121*a* to adjust the discharge displacement will flow out to the side of the suction chamber 123*b* by the pressure difference between the swash plate chamber 121*a* and the suction chamber 123*b*, but the worn powder is trapped by the filter 170. When the quantity of the trapped worn powder increases, that is, when the state of locking or the like progresses, the filter is filled with the trapped worn powder to close the exhaust passage 137*a*. Then, the pressure Pc in the swash plate chamber 121*a* varies only in an increasing direction, whereby the discharge displacement is varied to the minimum side. Therefore, it can prevent the compressor 100 from being brought into the trouble such as locking by the worn powder produced in the compressor 100.

Other Embodiment

Although the present invention has been fully described in connection with the preferred embodiments thereof with reference to the accompanying drawings, it is to be noted that various changes and modifications will become apparent to those skilled in the art.

For example, in the above first to ninth embodiments, assuming that the compressor 100 is of the swash plate type, descriptions have been given, but the compressor is not limited to the swash plate type. The present invention can be applied to a compressor of a wobble plate type or a bypass type (through vane type or scroll type) in which a part of refrigerant under compression is bypassed into the suction chamber side by a control valve.

Further, the compressor 100 can be used not only for the refrigerant cycle system 200 but also for a heat pump cycle. Still further, the compressor 100 can be applied to the refrigerant cycle system 200 not only for the vehicle but also for home use.

Such changes and modifications are to be understood as being within the scope of the present invention as defined by the appended claims.

What is claimed is:

1. A limiter device provided in a variable displacement compressor capable of compressing a fluid in a cycle and varying a discharge displacement of the fluid per revolution, the limiter device comprising:

a sensor for detecting at least one of the following characteristics; a temperature or a vibration at a predetermined portion of the compressor during a compression operation of the compressor; a quantity of wear powder flowing in the compressor with the fluid; a sliding position of a compression member of the compressor; and a discharge side pressure of the compressor; and a solenoid valve for minimizing the discharge displacement when the characteristic obtained by the sensor exceeds a predetermined value, wherein:

a current supplied to the solenoid valve is adjusted in response to a detection signal from the sensor and opens or closes a part of a communication passage of the fluid in the compressor to vary the discharge displacement;

the sensor is for detecting the quantity of the wear powder and is constructed of a positive pole part and a negative pole part;

the positive pole part and the negative pole part have tips that are disposed in the compressor and are arranged to have a predetermined potential difference therebetween; and the positive pole part is separated from the negative pole part in such a manner that they are brought into conduction when a predetermined amount of the wear powder adheres to them.

2. The limiter device according to claim 1, wherein the positive pole part is one of a plurality of positive pole parts and the negative pole put is one of a plurality of negative pole parts, and the plurality of the positive pole parts and the plurality of the negative pole parts are provided in an inner peripheral direction of the compressor.

3. The limiter device according to claim 1, wherein the positive pole part and the negative pole part are provided continuously in an inner peripheral direction of the compressor.

4. The limiter device according to claim 1, wherein:

the compressor has an inner space constructed of at least two outer housings;

the positive pole part is interposed between the two outer housings and includes a sheet metal and insulation members provided on both surfaces of the sheet metal; and the negative pole part is at least one of the two outer housings.

5. The limiter device according to claim 4, wherein the sheet metal is an electrode member having an annular shape, and the insulation members are made of rubber.

6. The limiter device according to claim 5, further comprising:

a lead wire bonded to a predetermined position in a circumferential direction of the sheet metal by a solder; and a resin part provided outside of the lead wire and the solder to seal a bonded part of the lead wire.

7. The limiter device according to claim 1, wherein the compressor is a swash plate type compressor in which a slanting angle of a swash plate received in a swash plate chamber is adjusted to vary the discharge displacement.

8. The limiter device according to claim 1, wherein the positive pole part includes a column part which is open at one end and has an approximately cylindrical shape, and a connection part is integrated with the column part and extends from the open end of the column part.

9. A limiter device provided in a variable displacement compressor, wherein the compressor is adapted to cyclically compress a fluid and vary a discharge displacement of the fluid, the limiter device comprising:

a sensor for detecting a quantity of wear powder in the compressor, wherein the sensor includes a positive pole and a negative pole, the positive pole and the negative pole are located inside the compressor, an electrical potential difference is provided between the positive pole and the negative pole, and the positive pole part is separated from the negative pole part in such a manner that an electrical current flows between the positive pole and the negative pole when a predetermined amount of the wear powder accumulates between the positive pole and the negative pole; and a solenoid valve for minimizing the discharge displacement when the quantity detected by the sensor exceeds a predetermined value, wherein a current, which is supplied to the solenoid valve, is adjusted in response to a detection signal from the sensor and opens or closes a part of a communication passage of the fluid in the compressor to minimize the discharge displacement.

10. The limiter device according to claim 9, wherein:

the compressor has an inner space constructed of at least two housing members;

the positive pole is located between the two housing members and includes a sheet metal part;

insulation members are provided on opposite surfaces of the sheet metal part; and the negative pole part is at least one of the two housing members.

11. The limiter device according to claim 10, wherein the sheet metal is an electrode member having an annular shape, and the insulation members are made of rubber.

12. The limiter device according to claim 10, further comprising:

a lead wire bonded to the sheet metal part by solder; and a resin pert provided outside of the lead wire and the solder to seal a bonded part of the lead wire.

13. The limiter device according to claim 9, wherein the compressor is a swash plate type compressor in which an inclination angle of a swash plate is adjusted to vary the discharge displacement.

14. The limiter device according to claim 9, wherein the positive pole includes a cylindrical part, which is open at one end, and a connection part is integrated with the cylindrical part and extends from the open end of the cylindrical part.

* * * * *